US005368461A

United States Patent [19]

Murphy

[11] Patent Number: 5,368,461

[45] Date of Patent: Nov. 29, 1994

[54] OUTSIDE CORNER FINISHING TOOL

[75] Inventor: Robert J. Murphy, Stockton, Calif.

[73] Assignee: Premier Drywall Tool Co., Stockton, Calif.

[21] Appl. No.: 102,409

[22] Filed: Aug. 5, 1993

[51] Int. Cl.[5] ..... B05C 17/00

[52] U.S. Cl. ..... 425/87; 15/235.3; 15/235.7; 401/266; 425/458

[58] Field of Search ..... 425/87, 458; 15/235.3, 15/235.7; 401/140, 265, 266; D8/95

[56] References Cited

U.S. PATENT DOCUMENTS

| | | | |
|---|---|---|---|
| 2,043,145 | 6/1936 | Bacher | 401/140 |
| 2,300,348 | 11/1942 | Ames | 425/87 |
| 2,594,606 | 4/1952 | Ames | 425/87 |
| 2,889,699 | 6/1959 | Ames | 425/87 |
| 3,070,827 | 1/1963 | Ames | 401/265 |
| 3,241,174 | 3/1966 | Callahan | 425/87 |
| 3,602,405 | 8/1971 | Ames | 401/261 |
| 4,032,283 | 6/1977 | Johnson et al. | 425/458 |
| 4,116,604 | 9/1978 | Johnson et al. | 425/458 |
| 4,230,441 | 10/1980 | Heronema | 425/87 |
| 4,295,242 | 10/1981 | Dixon | 15/235.7 |
| 4,451,223 | 5/1984 | Mower et al. | 425/458 |
| 4,664,611 | 5/1987 | Kumar | 425/87 |
| 4,732,503 | 3/1988 | Bader et al. | 401/140 |
| 4,907,955 | 3/1990 | Snipes | 425/87 |
| 5,010,618 | 4/1991 | Croft | 425/87 |
| 5,141,348 | 8/1992 | 'tartt | 401/140 |

*Primary Examiner*—Jay H. Woo
*Assistant Examiner*—Joseph Leyson
*Attorney, Agent, or Firm*—Donald C. Feix

[57] ABSTRACT

A generally polygonal block-like enclosure of rigid material including a top and bottom wall, a pair of a concave inward front walls which define an inner corner adapted to fit on an outside corner, and a back wall spaced from the front walls by a pair of spaced side wall. The back wall includes a centrally disposed spherical cavity sized for receiving a bail socket connector which is preferably retained therein by a spring clip or equivalent retaining means and each front wall includes a vertically oriented channel which extend between the top and bottom walls. The enclosure also includes a manifold which connects the spherical cavity in the back wall to each of the channels in the front wall. In operation, a pump-type applicator is connected to the ball socket connector and is operated to direct a regulated flow of mastic material to the spherical cavity which, in turn, is directed through the manifold to the vertical channels of the front walls for simultaneous deposition of a bead of mastic material along each of the two adjoining wall board sections as the tool is moved in the vertical direction along the outside corner.

8 Claims, 3 Drawing Sheets

OUTSIDE CORNER FINISHING TOOL

BACKGROUND OF THE INVENTION

1. Field of the Invention

The present invention relates to applicators and finishing tools for applying mastic or compound or plaster material to outside corner edges formed by drywall board sections such as are universally used in interior building walls.

2. Brief Description of the Prior Art

In one method for finishing an outside corner edge of two adjoining drywall board sections, a first layer of fast set compound or mastic material is applied, usually by hand, directly to the unfinished outside corner (of metal, plastic, or other conventional material as is well known in the art. Next, a corner is embedded onto the first mastic material layer by using a special pressing tool. The metal corner preferably has a sheet of paper material adhered to the outer surface thereof. Such paper-backed metal corners are generally referred to in the trade as "taped on metal corners". The paper backing typically extends a short distance beyond both vertical side edges of the metal corner bead such that they overlap adjacent portions of the two adjoining wall board sections. In accordance with the preferred technique, an amount of mastic material is squeezed out from beneath the side edges of the metal corner as the metal corner is embedded into the mastic material by the pressing tool. This excess material is hand wiped with a flat blade to finish and smooth the overlapping paper onto the wall board sections. It is desirable that the amount of mastic material squeezed out from beneath the metal corner not be excessive as this creates waste and is messy to properly finish.

In a second outside corner finishing method, a metal corner bead is secured to the outside corner using nails and/or screws after which a finishing coat of mastic or plaster material is applied to the outside corner (and metal corner bead). Various special tools have been developed for the application of mastic material to outside corners, and in particular outside corners which have been pre-fitted with a metal corner bead.

For example, U.S. Pat. No. 4,230,441 issued to J. D. Heronema discloses a rather complicated hand held tool consisting of a container for containing a supply of mastic material. The container has a first forward end with inwardly concave walls which conform to a 90 degree outside corner and a second, back end wall which is slidably movable towards the forward end when hand pressure is applied thereto. The sliding or piston movement of the back wall towards the forward end forces mastic material from inside the container through large openings in the forward end walls. The tool also includes wheels to guide the tool as it is moved along the outside corner and wipers with peripheral seals to spread and smooth the mastic material along the outside corner. It is readily apparent that such a complex tool is costly to acquire and that maintenance and clean up are time intensive. Also, a person using this hand tool may experience muscle soreness or fatigue in the arms, neck and/or back over prolonged periods of use in view of the amount of inwardly directed arm pressure and repeated stooping or bending required during use.

In another example, U.S. Pat. No. 4,907,955 issued to J. T. Snipes, there is disclosed a box-like device for containing a supply of plaster material and which includes a slot for dispensing the plaster material to a wall board adjacent a tacked on metal corner bead. The tool includes a guide member which engages a center ridge or upraised bead portion of the metal corner bead in order to keep the dispensing slot at a desired spaced distance from the apex of the outside corner.

Like the outside corner tool of Heronema described above, this tool also includes roller guide wheels and other adjustable parts which add to the expense and complexity of the tool. Further, this tool only permits the application of mastic material to one side of the outside corner at a time. Further still, this tool, like the tool of Heronema is directed for use in an outside corner finishing method wherein the outside corner has first been fitted with a metal corner, and in particular a metal corner bead, i.e., a metal corner having a center ridge or upraised bead portion. Accordingly, such tools are not suitable for use in finishing outside corners with beadless metal corners.

Accordingly there is a definite need for an improved outside corner finishing tool for use in drywall construction which overcomes the problems of the prior art. In particular, there is a need for an improved outside corner finishing tool for use in cementing a taped on metal corner to an unfinished outside corner.

SUMMARY OF THE INVENTION

List of Objectives

It is therefore a principal objective of the present invention to provide a simple and inexpensive outside corner finishing tool for simultaneously applying a bead layer of mastic material to both side walls of an outside corner wherein the bead layers are deposited with a sufficient width and thickness and are each spaced at a desired laterally distance from the apex of the outside corner to ensure an adequate bond between the outside corner edge and a taped on metal corner when embedded thereover.

It is another object of the invention to provide an outside corner finishing tool of the type described which reduces the time and labor required to apply mastic material for cementing a taped on metal corner to an outside corner and which does so with greater ease, more accuracy and without excessive waste of mastic material.

It is another object of the present invention to provide an outside corner finishing tool of the type described which may be used to cement a variety of the commonly used metal corners to an outside corner, such as the conventional metal corner bead having a center bead or upraised center ridge, a beadless or straight 90 degree metal corner bead and rounded metal corners.

It is another object of the present invention to construct an outside corner tool of the type described which may be used with a hand held pump-type applicator for providing a controllable flow of mastic material to the tool for deposition on the outside corner and which may be moved bidirectionally up and down the outside corner.

Briefly, a preferred embodiment of the present invention comprises a generally polygonal integral one piece block-like enclosure of rigid material including a top and bottom wall, a pair of concave inward front walls which define an inner corner adapted to conform to an outside corner, and a back wall spaced from the front walls by a pair of spaced side walls. The back wall includes a centrally disposed ball socket or spherical cavity sized for receiving a ball socket connector in a close tolerance fit within the spherical cavity. The ball socket connector is preferably retained in the spherical cavity, for pivotal movement within the spherical cavity, by a spring clip or equivalent retaining means. Each front wall includes a vertically oriented channel which extends between the top and bottom walls; and the channel is shaped to permit the tool to be moved bidirectionally on the corner. The ball socket connector has a through hole for transferring mastic material through the ball socket connector. The enclosure also includes a manifold which connects the spherical cavity in the back wall to each of the channels in the front walls. In operation, a pump-type applicator is connected by a connector end to the ball socket connector and is operated to force and to direct a regulated flow of mastic material from a reservoir out through the connector end and through the through hole in the connector ball socket to the spherical cavity. The regulated flow of material flows from the spherical cavity through the manifold to the vertical channels of the front walls for simultaneous deposition of a bead of mastic material adjacent an outside corner formed by two adjoining wall board sections as the tool is moved, unidirectionally or bidirectionally in the vertical direction along the outside corner.

The manifold includes a pair of oval or pill-shaped dispersing cavities which are individually disposed within each of the channels. The dispersing cavities facilitate the controlled flow of mastic material to the channels.

The depth and width dimensions of the channels and the respective lateral distance spacings of the channels from the apex of the corner and the free edges of the respective front walls are selected to provide a sufficient amount of deposited mastic material on the wall boards to ensure adequate coverage for cementing a taped on metal corner when embedded to the outside corner without excessive waste of mastic material. In this regard, each channel is spaced closer to the free vertical side edge of their respective front walls than they are to the apex of the corner. It should be noted, however, that contrary to popular misconception, it is not necessary to completely coat the apex of the outside corner with mastic material in order to ensure a positive bond between the tapped on metal corner to the unfinished outside corner. Indeed, it has been found that to do so promotes waste of mastic material as an excessive amount is usually squeezed out from beneath the edges of the taped on metal corner as it is embedded onto the applied mastic layer.

List of advantages

An important advantage of the present invention is that the two channels of the concave inward front walls permit the simultaneous deposition of a sufficient amount of mastic material to both adjoining wall boards adjacent an outside corner formed therebetween without excessive waste of mastic material. The two channels are shaped to permit the corner tool to be moved in either direction up and down the outside corner and also to permit the tool to be moved bidirectionally up and down the outside corner.

Another advantage of the present invention is that the tool is easier to use than the hand held designs of the prior art since mastic material is no longer contained within the tool itself but rather is supplied at a controllable rate of flow by hand held pump-type applicator.

These and other objects and advantages of the present invention will no doubt become apparent to those skilled in the art from the following drawings, detailed description of the preferred embodiment and the appended claims.

DESCRIPTION OF THE PREFERRED EMBODIMENT

Figure 1:
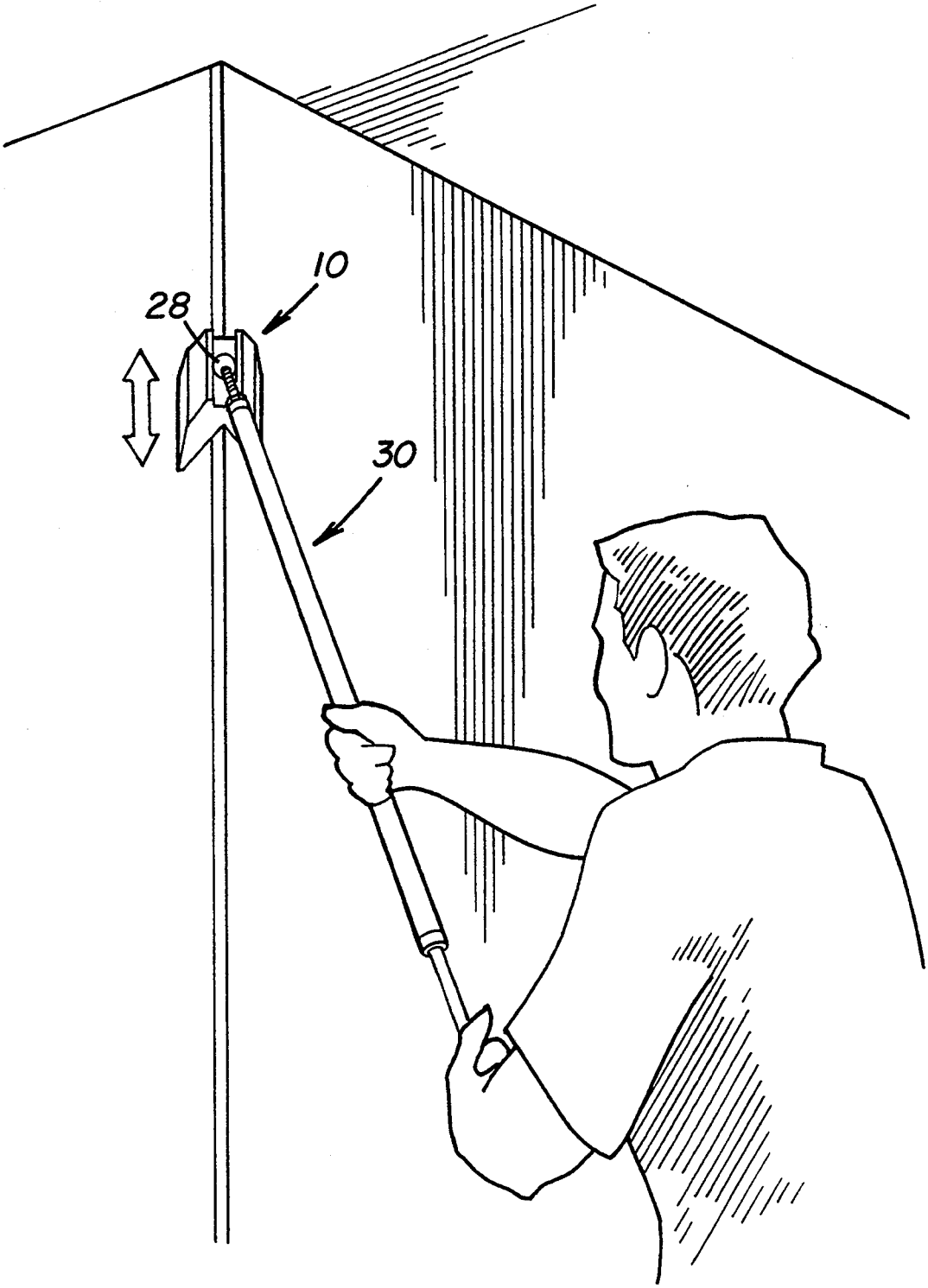
FIG. 1 is a perspective view of the outside corner finishing tool of the present invention shown in combination with a pump-type applicator for use in the simultaneous application of two bead layers of mastic material adjacent the outside corner apex of two adjoining wall board sections.

The following detailed description illustrates the invention by way of example, not by way of limitation of the principles of the invention. This description will clearly enable one skilled in the art to make and use the invention, and describes several embodiments, adaptations, variations, alternatives and uses of the invention, including what is presently believed to be the best mode of carrying out the invention.

An outside corner finishing tool constructed in accordance with one embodiment of the present invention is indicated generally by the reference numeral 10 in FIGS. 1–6.

As best seen in FIGS. 2–6, the tool 10 comprises a generally polygonal integral, one piece block of rigid material having a top wall 12, a bottom wall 14, a pair of concave inward front walls 16 which define an inner corner of approximately 90 degrees, a back wall 18 and two pairs of spaced apart side walls 20, 22. The bottom wall 14 is preferably slanted at an upward angle in order to facilitate the application of a desired amount of mastic material adjacent a bottom floor region of an outside corner. The upper wall may be similarly slanted if desired, especially for outer corners which adjoin a ceiling. While each side portion of the tool 10 as disclosed is comprised of two outwardly angled side walls 20 and 22, it is understood that single flat walls may be substituted therefor without adverse result on the effectiveness of the tool.

The back wall 18 includes a centrally disposed, vertically oriented channel 24 which includes a spherical cavity or socket 26 disposed therein sized for receiving a conventional ball joint connector 28. The ball joint connector 28 provides connection to a drywall dispensing tool, such as the pump-type drywall compound applicator 30 shown in FIG. 1. The ball joint connector 28 is preferably retained within the socket or spherical cavity 26 by a spring clip 32, which in use, engages grooves 34 provided in the opposed facing upstanding walls of channel 24.

Figure 3:
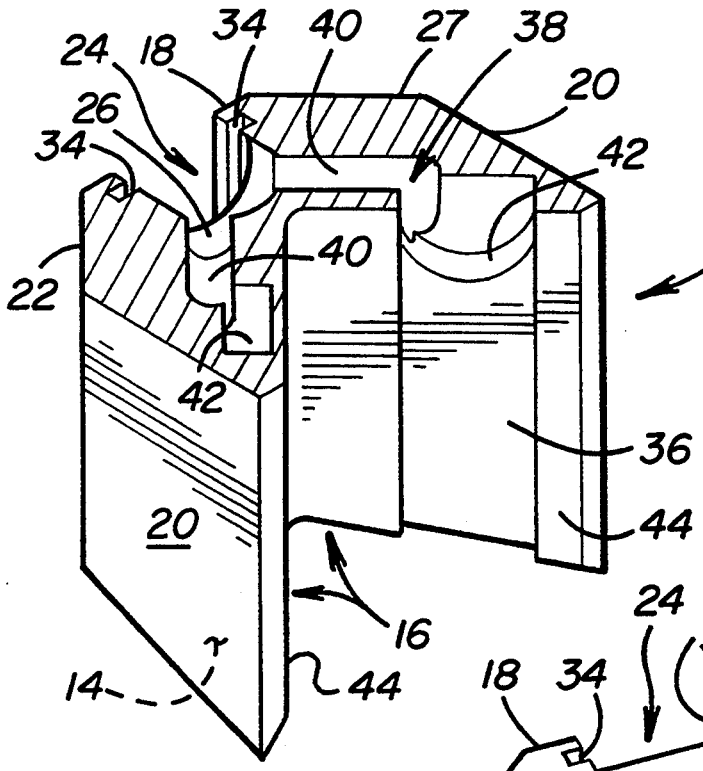
FIG. 3 is cross section isometric view taken along the line and in the direction of arrows 3—3 of FIG. 2.

The front walls 16 each include a vertically oriented channel 36 which extends between the top wall 12 and the bottom wall 14. As best seen in FIG. 3, the tool 10 further includes a generally Y-shaped manifold 38 for connecting the spherical cavity 26 of the back wall 18 to each of the vertically oriented channels 36 of the front walls 16. Each branch of the Y-shaped manifold includes a port 40 which feeds into a cavity 42 set within each channel 36.

Figure 2:
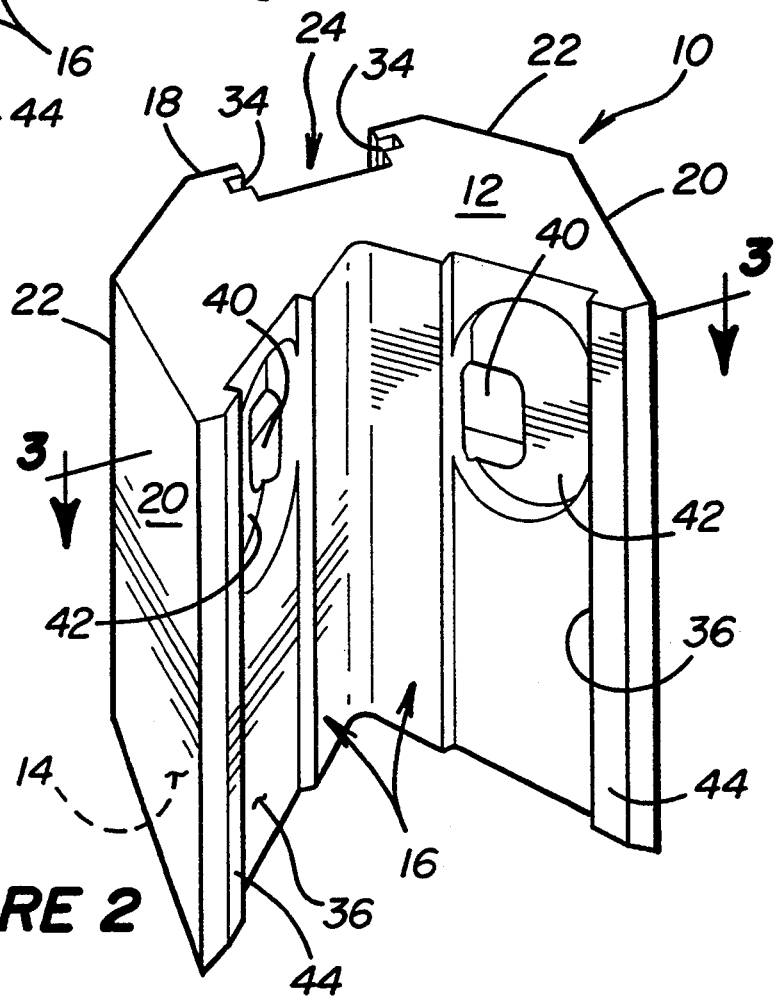
FIG. 2 is isometric view of the outside corner finishing tool of the present invention showing the detail of the vertically oriented channels of the concave inward front walls.
Figure 4:
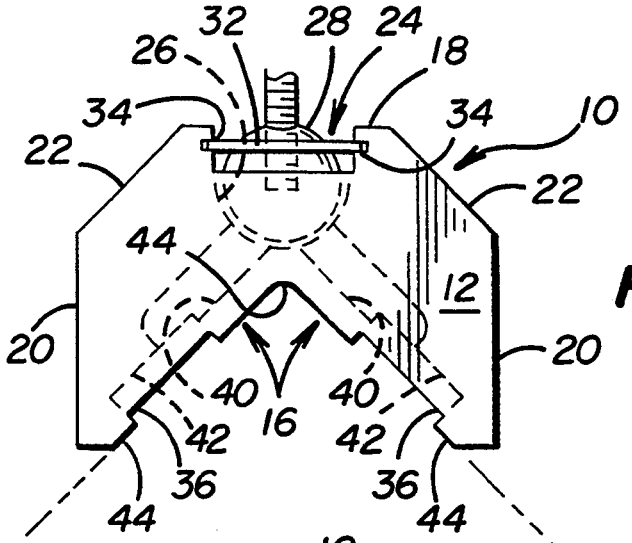
FIG. 4 is a top end view of the outside corner finishing tool.
Figure 5:
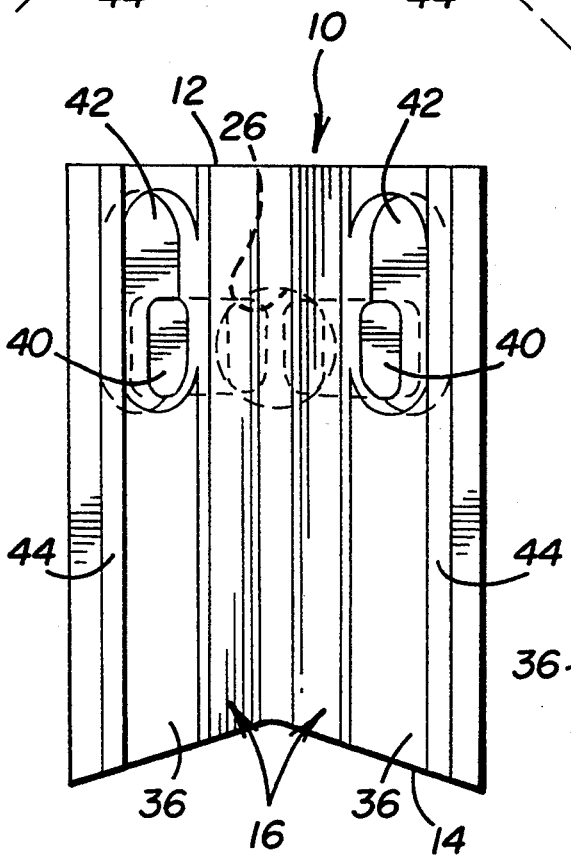
FIG. 5 is a front elevation view of the outside corner finishing tool.
Figure 6:
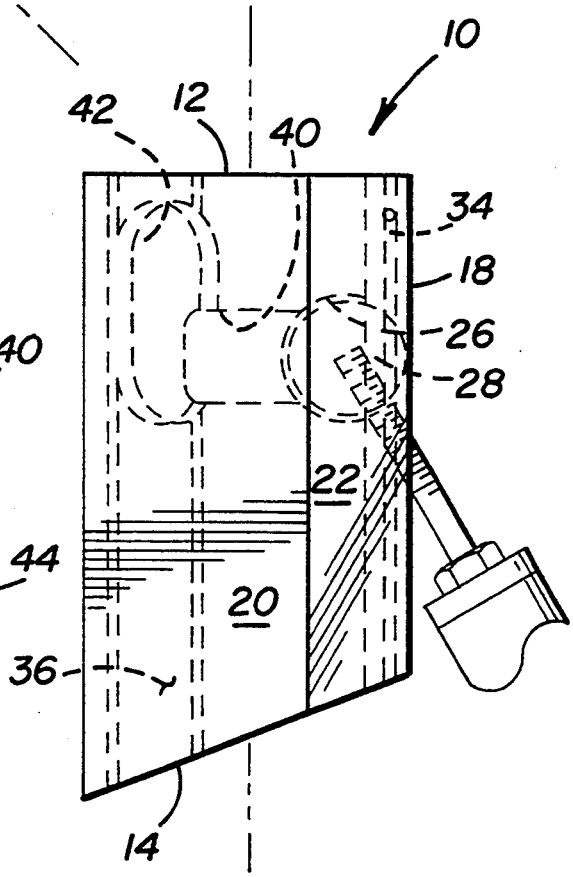
FIG. 6 is a side elevation view of the outside corner finishing tool.

In operation, mastic material enters the spherical cavity 26 and is directed equally through each port 40 into its respective disbursing cavity 42 where it is then fed into the channels 36. As the tool is moved along the outside corner, the mastic material fed into the channels 36 is deposited along the outside corner in two strips which are spaced at a distance from the apex of the outside corner. As best shown in FIG. 2, each channel 36 has a uniform width throughout. This construction permits the tool to be moved in either direction up or down the outside corner and also permits the tool to be moved bidirectionally up and down the outside corner.

In a preferred embodiment of the invention, the channels 36 are 0.75" wide and have depth of 0.075". Also, each channel 36 is preferably spaced at a distance of 11/16" from the inside corner apex 44 (see FIG. 4) of the tool 10. Each front wall 16 includes a lengthwise runner 44 which defines the outer edge boundary of each channel 36. The runners 44 may be of any desired width. It should be noted that the above specified dimensions are selected for use with standard size taped on metal corners and the above dimensions ensure that the tool 10 applies the mastic material at desired locations for bonding the paper backing of the taped on metal corner to the adjacent drywall portions.

It should also be noted that unlike the outside corner finishing tools of the prior art, the channels do not deposit mastic material on the apex of the outside corner itself. It has been found that the above dimensions for the channels and their location with respect to the apex of the outside corners during use deposit a sufficient amount of mastic material to ensure a positive bond with the taped on metal corner even though mastic material may not completely surround the apex of the corner in all cases. Also, by selectively dimensioning the width and depth of the channels and their relative spacing from the corner apex, excess waste of mastic material is substantially reduced. It is understood that the specific dimensions for width, depth and spacing from the apex may be varied as desired for use with non-standard size taped on metal corners.

The materials of construction for the tool 10 may include metal such as stainless steel, aluminum, or any hard plastic such as, for example, delrin. In the case of metal, it is preferred that the piece be formed with the die casting process or even a sand casting process with some machining. In the case of plastic, the piece may be machined or even cast.

It should be understood that various modifications within the scope of this invention can be made by one of ordinary skill in the art without departing from the spirit thereof. We therefore wish our invention to be defined by the scope of the appended claims as broadly as the prior art will permit, and in view of the specification if need be.

I claim:

1. An outside corner finishing assembly for use in applying mastic material simultaneously to both a first and second wall adjacent an edge of an outside corner, said mastic material for cementing a metal corner to said outside corner, said outside corner finishing assembly comprising:

a) an outside corner tool constructed to be used unidirectionally or bidirectionally in a vertical direction on said outside corner and including an integral, one piece, polygonal body of rigid material having a top wall, a bottom wall, a pair of concave inward front walls defining a 90 degree inside corner and adapted to engage with and to slide on the first and second walls adjacent the outside corner, a back wall spaced from said front walls by a pair of spaced apart side walls, and wherein:

i) each of said front walls includes a vertically oriented channel member extending between said bottom and top walls, said channel member having a uniform width so that said outside corner tool can be moved in either vertical direction on said outside corner and can be moved bidirectionally up and down the outside corner;

ii) said back wall includes a generally spherical cavity disposed therein;

iii) said tool includes a manifold disposed within said body for connecting said spherical cavity to each of said channel members;

b) a ball socket connector member sized for close tolerance fit within said spherical cavity of said back wall and including a through hole for transferring mastic material through the ball socket connector member;

c) means for retaining said ball socket connector member in pivotal relation within said spherical cavity; and d) a mastic material applicator including a connector end for connection to said ball socket connector member, a reservoir for containing a supply of mastic material, and means for forcing a regulated flow of said mastic material from said reservoir out through said connector end and through the through hole in the

2. An outside corner finishing assembly as in claim 1 wherein said manifold includes:

a) a first dispersing cavity disposed within one of said channel members;

b) a first port connecting said first dispersing cavity to said spherical cavity;

c) a second dispersing cavity disposed within the other of said channel members; and d) a second port connecting said second dispersing cavity to said spherical cavity.

3. An outside corner finishing assembly as in claim 2 wherein:

a) said means for retaining said ball socket connector member comprises a spring clip; and b) said back wall includes a vertical lengthwise channel having slots formed in upstanding channel walls thereof for receiving said spring clip.

4. An outside corner finishing assembly as in claim 3 wherein at least one of said top and bottom walls is slanted at an acute angle with respect to a horizontal plane extending through an adjacent flooring or ceiling member to facilitate positioning of said tool along said outside corner adjacent the respective flooring or ceiling member.

5. An outside corner finishing tool for use in combination with an applicator which includes means for supplying a controlled flow of mastic material to said tool for applying mastic material simultaneously to both a first and second wall adjacent an edge of an outside corner, said outside corner finishing tool being constructed to be used unidirectionally or bidirectionally in a vertical direction on said outside corner and comprising:

a) a generally polygonal, integral, one piece body having a top wall, a bottom wall, a pair of concave inward front walls defining a 90 degree inside corner and adapted to engage with and to slide on the first and second walls adjacent the outside corner, a back wall spaced from said front walls by a pair of spaced apart side walls, and wherein:

i) each of said front walls includes a vertically oriented channel member extending between said bottom and top walls, said channel member having a uniform width so that said outside corner tool can be moved in either vertical direction on said outside corner;

ii) said back wall includes a generally spherical cavity disposed therein, said spherical cavity being sized for receiving a provided ball socket connector for connection with a provided applicator;

iii) said tool including a manifold disposed within said body for connecting said spherical cavity to each of said channel members;

b) means for retaining said provided ball socket connect,or in pivotal relation within said spherical cavity; and whereby c) mastic material supplied to said spherical cavity flows through said manifold to said channels member and is deposited in a lengthwise strip along each of said first and second walls adjacent said outside corner as said tool is moved along a length thereof with said concave inward front walls of said tool contacting said outside corner.

6. An outside corner finishing assembly as in claim 5 wherein said manifold includes:

a) a first dispersing cavity disposed within one of said channel members;

b) a first port connecting said first dispersing cavity to said spherical cavity;

c) a second dispersing cavity disposed within the other of said channel members; and d) a second port connecting said second dispersing cavity to said spherical cavity.

7. An outside corner finishing assembly as in claim 6 wherein:

a) said means for retaining said provided ball socket connector comprises a spring clip; and b) said back wall includes a vertical lengthwise channel having slots formed in upstanding channel walls thereof for receiving said spring clip.

8. An outside corner finishing assembly as in claim 7 wherein at least one of said top and bottom walls is slanted at an acute angle with respect to a horizontal plane extending through an adjacent flooring or ceiling member to facilitate positioning of said tool along said outside corner adjacent the respective flooring or ceiling member.

* * * * *

UNITED STATES PATENT AND TRADEMARK OFFICE

CERTIFICATE OF CORRECTION

PATENT NO. : 5,368,461

DATED : November 29, 1994

INVENTOR(S) : Robert J. Murphy

It is certified that error appears in the above-indentified patent and that said Letters Patent is hereby corrected as shown below:

Column 1, line 17, delete "in the art." and insert --in the art).--

Column 6, line 44, add --ball socket member and into said manifold, said applicator in combination with said tool being operable to deposit a lengthwise strip of mastic material along each of said first and second walls adjacent said outside corner as said tool is moved along a length thereof with said concave inward front walls of said tool contacting said outside corner.--

Column 8, line 2, delete "connect,or" and insert --connector--.

Column 8, line 5, delete "channels" and insert --channel members--.

Signed and Sealed this

Twenty-eight Day of March, 1995

*Attest:*

Bruce Lehman

BRUCE LEHMAN

*Attesting Officer*

*Commissioner of Patents and Trademarks*